US009458580B2

(12) United States Patent
Suzuki et al.

(10) Patent No.: US 9,458,580 B2
(45) Date of Patent: Oct. 4, 2016

(54) COMPACTION ROLLER

(71) Applicant: Sakai Heavy Industries, Ltd., Minato-ku, Tokyo (JP)

(72) Inventors: Sadayoshi Suzuki, Kawagoe (JP); Hiroaki Neko, Kawagoe (JP); Akira Mitsui, Kuki (JP)

(73) Assignee: Sakai Heavy Industries, Ltd., Minato-ku, Tokyo (JP)

( * ) Notice: Subject to any disclaimer, the term of this patent is extended or adjusted under 35 U.S.C. 154(b) by 0 days.

(21) Appl. No.: 14/839,043

(22) Filed: Aug. 28, 2015

(65) Prior Publication Data

US 2016/0060821 A1 Mar. 3, 2016

(30) Foreign Application Priority Data

Aug. 29, 2014 (JP) ..... 2014-174976

(51) Int. Cl.
*E01C 19/28* (2006.01)

(52) U.S. Cl.
CPC ..... *E01C 19/286* (2013.01); *E01C 19/287* (2013.01)

(58) Field of Classification Search
CPC ..... E01C 19/23; E01C 19/26; E01C 19/27; E01C 19/266; E01C 19/282; E01C 19/286; E01C 19/287
USPC ..... 404/117, 122, 128, 132
See application file for complete search history.

(56) References Cited

U.S. PATENT DOCUMENTS 2,466,822 A * 4/1949 Pollitz ..... E01C 19/287 172/40
3,161,250 A * 12/1964 Gardner ..... B60K 17/165 180/233
5,494,375 A * 2/1996 Yates ..... E01C 19/27 172/518
5,788,408 A 8/1998 Mitsui et al.

FOREIGN PATENT DOCUMENTS

| | | | |
|---|---|---|---|
| CN | 200971466 | Y | 11/2007 |
| EP | 0754802 | A1 | 1/1997 |
| JP | H09-031912 | A | 2/1997 |
| JP | 2000-184022 | A | 6/2000 |
| JP | 2003-184022 | A | 7/2003 |

OTHER PUBLICATIONS

Feb. 8, 2016—(EP) Partial EP Search Report—App 15182898.5.

* cited by examiner

*Primary Examiner* — Gary Hartmann
(74) *Attorney, Agent, or Firm* — Banner & Witcoff, Ltd.

(57) ABSTRACT

A compaction roller comprises a vibration device for generating vibrations when driven by a vibration motor; a pair of right and left traveling drive shafts, while traveling driving outside tires and their adjoining inside tires synchronously, for transmitting the vibrations of the vibration device to the outside tires and inside tires; a pair of right and left traveling motors respectively for driving their associated traveling drive shafts; and, a pair of right and left first support brackets mounted through a first vibration proof device 6 on a vehicle body and interposed between the outside tires and inside tires for supporting the traveling drive shafts through bearings, wherein the vibration device includes a vibration source disposed within the traveling drive shafts. According to the compaction roller, a side overhang can be eliminated or reduced, and enabling prevention of the lowered vibration compacting function of the tires.

5 Claims, 15 Drawing Sheets

COMPACTION ROLLER

CROSS-REFERENCE TO RELATED APPLICATION

The present application claims the benefit of priority of Japanese Patent Application No. 2014-174976, filed on Aug. 29, 2014, which is incorporated herein by reference.

TECHNICAL FIELD

The invention relates to a self-propelled compaction roller including tires and a vibration mechanism.

BACKGROUND ART

As one kind of compaction roller, a self-propelled ride-on type vibration tire roller, which roller has the front and rear wheels, at least one of which is constituted of tires, is known (see the JPA Publications No. H09-31912 and No. 2003-184022). In the vibration tire roller of the JPA Publication No. H09-31912, there is no differential mechanism so the right side tires and left side tires thereof cannot rotate different speeds in a compaction operation in a curve, and the surface to be compacted can be damaged. Also, since a distance from the outside surface of the most outside tire to a tire support member situated on the side portion of a vehicle body, a so-called side overhang is large, compaction in the vicinity of a road incidental structure is impossible.

Meanwhile, in the JPA Publication No. 2003-184022, a technology in which a tire support member is interposed between adjoining tires and a traveling motor for tire driving is mounted on the tire support member is disclosed. According to this technology, while there is right and left differential mechanism, interposition of the tire support member between the tires eliminates the need to dispose the tire support member outwardly of the most outside tire, thereby enabling reduction of the side overhang. Thus, advantageously, the most outside tire can be put further accordingly closer to the road incidental structure for compaction.

This technology provides a structure that, a vibration device is extended between paired right and left tire support members, and each tire support member is interposed outer side tire and inner side tire, of four tires. In this structure, vibrations can be transmitted efficiently to the two inside tires but are hard to be transmitted to the two outside tires. Thus, vibration differences tend to occur between four tires.

SUMMARY OF THE INVENTION

The compaction roller of the present invention has been made to solve the above problems, and thus it is an object of the invention to provide a compaction roller which can eliminate or reduce a side overhang and can apply vibrations to the respective tires evenly.

In the compaction roller of the present invention, a front wheel or a rear wheel is including four tires coaxially arranged side by side in a vehicle width direction and four tires are arranged in two pairs in which one pair is arranged in a right side of the compaction roller and the other pair is arranged in a left side of the compaction roller. Specifically, the compaction roller comprises a pair of traveling drive shafts, each of which is arranged corresponding to one of the two pairs of tires and drives an outside tire and its adjoining inside tire of the corresponding pair of tires synchronously and transmits a vibration from a vibration device, which generates the vibration when driven by a vibration motor, to the outside and inside tires, a pair of traveling motors, each of which is arranged corresponding to one of the pair of traveling drive shafts and drives the corresponding traveling drive shaft, and a pair of first support brackets, each of which is arranged corresponding to one of the pair of traveling drive shaft and is mounted through a first vibration proof device on a vehicle body and interposed between the outside and inside tires and supports the corresponding traveling drive shaft through a bearing device. Moreover, the vibration device includes a pair of vibration sources each of which is disposed within the corresponding traveling drive shaft.

The compaction roller of the invention provides the following effects.

- Since one of the pair of vibration sources is disposed inside one of the pair of traveling drive shaft for driving one of the two pairs of tires and the other of the pair of vibration sources is disposed inside the other of the pair of traveling drive shaft for driving the other of the two pairs of tires, variation deference can be reduced between one of the two pairs of tires and between the other of the two pairs of tires. Therefore, vibrations can be transmitted to all of the four tires highly efficiently.
- The right two tires and left two tires can be rotated different speeds relative to each other.

Moreover, the compaction roller of the present invention is preferably further including a second support bracket which is connected to both of the pair of first support brackets on an unsprung mass side than the first vibration proof device and interposed between the inside tires, and supports one of the pair of traveling motors.

Since the second support bracket is connected to the first support bracket on the unsprung mass side than the first vibration proof device, it has a function to receive the drive rotation reaction force of the traveling motor without applying a sprung load to the traveling motor.

The compaction roller of the invention provides the following effects.

- Interposition of the second support bracket between the inside tires can eliminate or reduce a side overhang.
- Connection of the second support bracket to both of the paired right and left first support brackets provides the following effect. Supposing two tires existing across the first support bracket balance in mass with each other and vibrations generated by the vibration source are applied substantially to the central positions of the two tires, when the vibrations of the vibration source are transmitted to the two tires, they vibrate normally substantially with the same motion. However, actually, between the two tires existing across the first support bracket, the mass balance may be caused to differ in the vehicle width direction depending on the design of the lay-out structures of the traveling drive shaft, vibration device, traveling motor, vibration motor and the like. In this case, when the vibrations of the vibration source are transmitted to the two tires, they vibrate with abnormal oscillations around the horizontal axis in the vehicle body longitudinal direction relative to each other. To solve this problem, the second support bracket is connected to both of the paired right and left first support brackets, thereby enabling positive prevention of the abnormal oscillations of the tires around the horizontal axis in the vehicle body longitudinal direction.

Moreover, the compaction roller of the present invention is preferably further including a second support bracket which is connected to the vehicle body through a second vibration proof device and interposed between the inside tires, and supports one of the pair of traveling motors.

The compaction roller of the invention provides the following effects.

Interposition of the second support bracket between the inside tires can eliminate or reduce a side overhang.

The drive rotation reaction force of the traveling motor is received by a simple structure using the second support bracket mounted on the vehicle body through the second vibration proof device, thereby enabling prevention of the abnormal oscillations of the tires around the horizontal axis in the vehicle body longitudinal direction.

Moreover, the compaction roller of the present invention is preferably further including a third support bracket which is connected to the vehicle body and situated outwardly of the outside tire in the vehicle width direction, and supports the vibration motor.

According to the invention, although slight protrusion of the third support bracket for receiving the drive rotation reaction force of the vibration motor incurs a side overhang, as a traveling motor, an expensive specific hollow-structure motor may not be used, thereby enabling provision of an economical compaction roller.

Moreover, the compaction roller of the present invention is preferably characterized in that the vibration motor is supported by the second support bracket, each of the traveling motors is constituted of a motor of a hollow-structure having a penetration hole, and the vibration motor and the vibration source are connected through the penetration hole to each other by a shaft member.

According to the compaction roller of the invention, by using the hollow-structure motor as the traveling motor, the side overhang can be eliminated.

Also, the present invention provides a compaction roller in which a front wheel or a rear wheel is including four tires coaxially arranged side by side in a vehicle width direction and four tires are arranged in two pairs in which one pair is arranged in a right side of the compaction roller and the other pair is arranged in a left side of the compaction roller. Specifically, the compaction roller comprises a vibration device configured to generate vibrations when driven by a vibration motor, a pair of traveling drive shafts, each of which is arranged corresponding to one of the two pairs of tires and drives an outside tire and their adjoining inside tire of the corresponding pair of tires synchronously and transmits the vibration from the vibration device to the outside and inside tires, a pair of traveling motors, each of which is arranged corresponding to one of the pair of traveling drive shafts and drives the corresponding traveling drive shaft, a pair of first support brackets, each of which is arranged corresponding to one of the pair of traveling drive shaft and is mounted through a first vibration proof device on a vehicle body and is interposed between the outside and inside tires and supports the corresponding traveling drive shaft through bearing device, and a second support bracket, which is connected to both of the pair of first support brackets on an unsprung mass side than the first vibration proof device and is interposed between the inside tires of the two pairs of tires and supports the pair of traveling motors. Moreover, the vibration device includes a vibrator case extended between the pair of first support brackets above the tires, and the second support bracket is connected to the vibrator case.

The compaction roller of the invention provides the following effects.

Since the support bracket of the vibration motor need not be arranged outwardly of the outside tires, the side overhang can be eliminated.

Connection of the second support bracket through the vibrator case to both of the paired right and left first support brackets on the unsprung mass side than the first vibration proof device can surely prevent the right two tires against vibration with abnormal oscillation around the horizontal taxis in the vehicle body longitudinal direction due to a mass balance difference between the right two tires, design errors of the position of the eccentric weight, manufacturing errors and the like. This applies similarly to the left two tires as well.

The right two tires and left two tires can be carried out differential rotation relative to each other.

As the traveling motor, an expensive specific hollow-structure motor need not be used, and one vibration device on one vibration motor may be used.

According to the compaction roller of the invention, the side overhang can be eliminated or reduced, and the lowered vibration compacting function of the tires relative to the surfaces to be compacted can be prevented.

DETAILED DESCRIPTION

Figure 1:
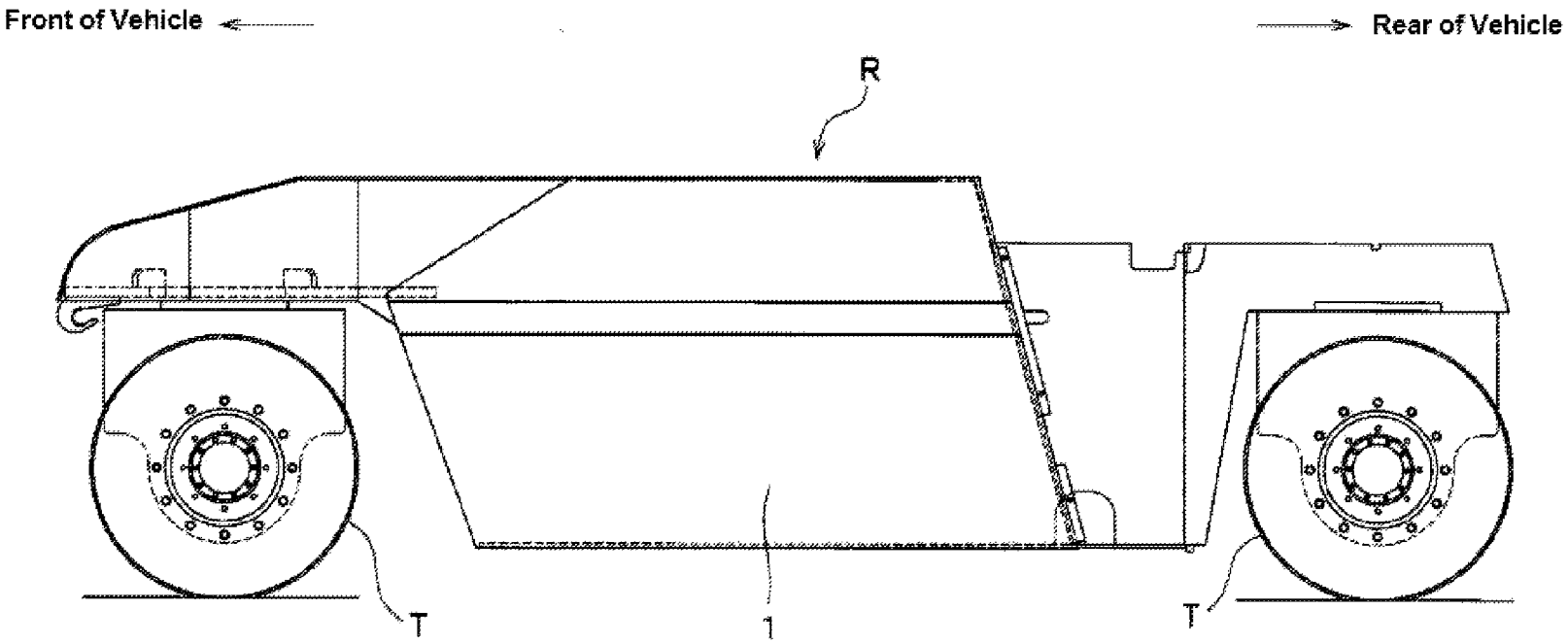
FIG. 1 is a side view of a vibration tire roller (an operator's seat and the like are not shown).

As an embodiment of a compaction roller of the invention, a vibration tire roller, to which the present compaction roller is applied, is described below with reference to the drawings. In FIG. 1, the vibration tire roller R includes a vehicle body 1 with an operator seat (not shown) arranged near to the rear portion thereof and, as front and rear wheels, multiple (in this embodiment, three front tires and four rear tires) tires T arranged side by side coaxially in the vehicle width direction. The tires T of the front and rear wheels are arranged at equal intervals in the vehicle width direction or in a manner almost similar to this state. In the following, description is given of five embodiments applied to the rear wheel side including four tires T. However, when the front wheel includes four tires, the invention can also be applied to the front wheel side. Here, the four tires are given designations T1, T2, T3 and T4 starting sequentially from one of the outside tires.

First Embodiment

Figure 2:
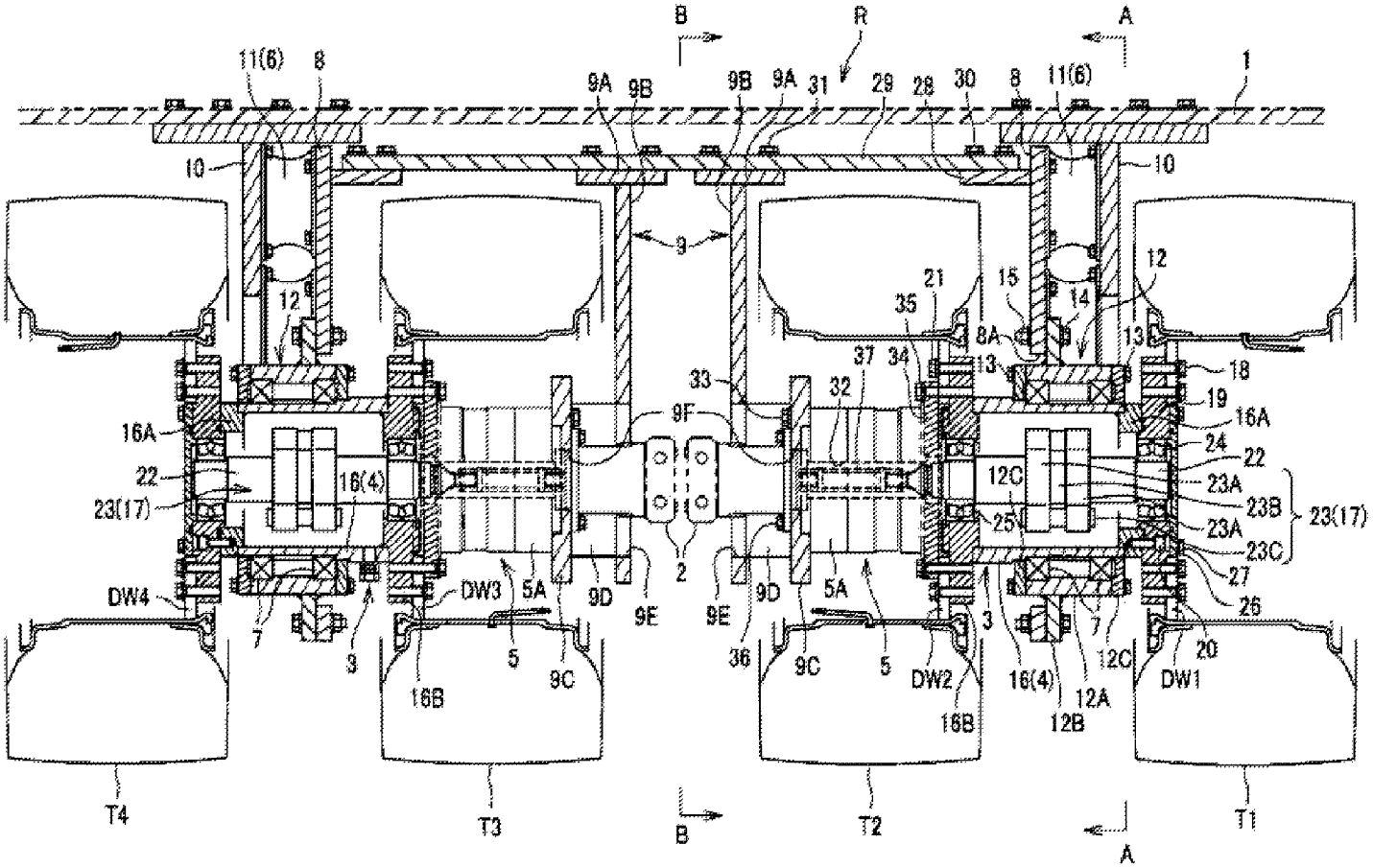
FIG. 2 is a rear view of a first embodiment of the invention around tires.

Description is given of a first embodiment with reference to FIG. 2. The vibration tire roller R includes: a vibration device 3 for generating vibrations when driven by a vibration motor 2; paired right and left traveling drive shafts 4, 4, while traveling driving the outside tires T1, T4 and their adjoining inside tires T2 (adjoining T1), T3 (adjoining T4) synchronously, for transmitting the vibrations of the vibration device 3 to the outside tires T1, T4 and inside tires T2, T3; paired right and left traveling motors 5, 5 respectively for driving the traveling drive shafts 4; paired right and left first support brackets 8, 8 mounted on a vehicle body 1 through a first vibration proof device (which is hereinafter called vibration proof device simply) 6 and interposed between the outside tires T1, T4 and inside tires T2, T3 for supporting the traveling drive shafts 4 through bearings 7; and, second support brackets 9 connected to both of the paired right and left first support brackets 8, 8 on the unsprung mass side than the vibration proof device 6 and interposed between the inside tires T2, T3 for supporting the traveling motors 5. In this embodiment, the second support brackets 9 are arranged as they are paired right and left. In the invention, "second support brackets 9 connected to both of the paired right and left first support brackets 8, 8 on the unsprung mass side than the vibration proof device 6 and interposed between the inside tires T2 and T3 for supporting the traveling motors 5" means that both of the right and left second support brackets 9 satisfy the requirements "they are connected to both of the paired right and left first support brackets 8, 8 on the unsprung mass side than the vibration proof device 6".

The structure around the tires T1 and T2 and the structure around the tires T3 and T4 are symmetrical and, in the following, description is given specifically of the structure around the tires T1 and T2.

Here, "sprung mass" means the mass of the vibration tire roller R on the side nearer to the vehicle body 1 than the vibration proof device 6, while "unsprung mass" means the mass of the vibration tire roller R on the side nearer to the tire T than the vibration proof device 6.

Figure 3:
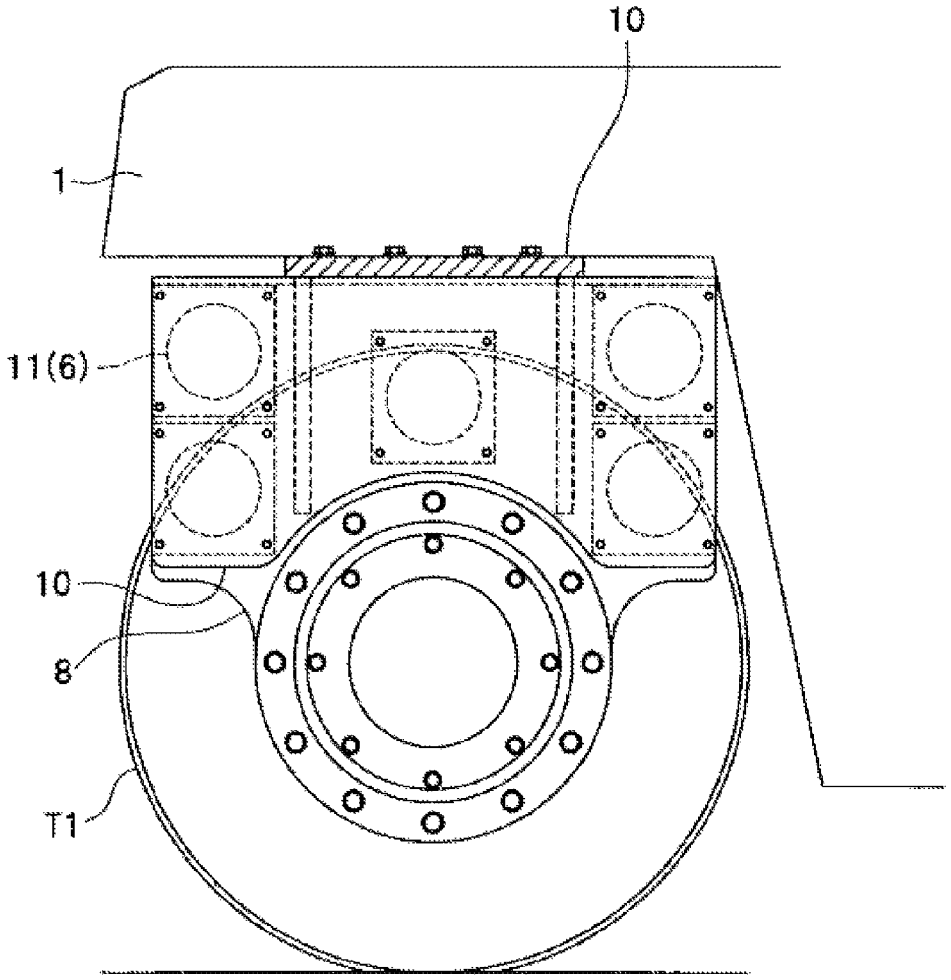
FIG. 3 is a section view taken along the A-A of FIG. 2.

A vertical plate-like bracket 10 is fixed to and hung down from the vehicle body 1 to extend along the vehicle longitudinal direction between the tires T1 and T2. The bracket 10, as shown in FIG. 3, has an oblong rectangular shape and the central portion of the lower side thereof has an arc-like recessed shape in order to prevent interference with a bearing holder 12 which is discussed later. On the plate surface side of the bracket 10 opposed to the tire T2, vibration proof rubber members 11 constituting the vibration proof devices 6 are mounted multiple (in the drawings, five). The five vibration proof rubber members 11 are arranged substantially in the four corners and center of the plate surface of the oblong rectangular bracket 11. The first support bracket 8 is mounted on the bracket 11 through the multiple vibration proof rubber members 11. The vibration proof rubber members 11 each have a substantially cylindrical shape and are mounted onto the brackets 10 and first support brackets 8 by bolts. The first support bracket 8 is a member having a vertical plate-like shape and, as shown in FIG. 3, its upper portion has an oblong rectangular shape substantially as large as the bracket 10 and is arranged opposed to the bracket 10 across the vibration proof rubber member 11 while it is substantially superimposed on the bracket 10 in its side view. The lower portion of the first support bracket 8 has a substantially semi-circular shape and, in the center of the substantially semi-circular shape, as shown in FIG. 2, a penetration hole 8A is formed insertion of the bearing holder 12.

The bearing holder 12 includes a cylindrical portion 12A arranged coaxially with the tire axis and having two opened ends, a flange portion 12B projected integrally from the outer periphery of the cylindrical portion 12A, and cover portions 12C, 12C respectively mounted on the two openings of the cylindrical portion 12A and having penetration holes for insertion of the traveling drive shafts 4. The bearing holder 12, with the cylindrical portion 12A penetrating through the penetration hole 8A of the first support bracket 8, is fixed to the first support bracket 8 by the bolt 14 and nut 15. The outer rings of the paired bearings 7 and 7 are fitted into the inner peripheral surface of the cylindrical portion 12A.

Each vibration device 3 includes a vibrator case 16 and a vibration source 17 arranged within the vibrator case 16. In this embodiment, each vibrator case 16 constitutes a traveling drive shaft 4, that is, each vibration source 17 is arranged within the traveling drive shaft 4. Each vibrator case 16 is a cylindrical member arranged coaxially with the tire axis and having two open ends and, when it is fitted with the inner surfaces of the inner rings of the bearings 7 and 7, it is rotatably supported on the first support bracket 8 through the bearings 7. The vibrator case 16 has the two end openings of on the opening near to the tire T1, a flange part 16A is mounted facing radially inward by welding or the like; and, on the opening near to the tire T2, there is mounted a flange part 16B facing radially outward and inward by welding or the like.

The disk wheel DW1 of the tire T1 is situated nearer to the tire T2 than the tire width center thereof, while the disk wheel DW2 of the tire T2 is situated nearer to the tire T1 than the tire width center thereof. The vibrator case 16, in the flange part 16A, is fixed by a bolt 20 to a hub 19 fixed by a bolt 18 to the disk portion of the disk wheel DW1 and, in the flange part 16B, is fixed by a bolt 21 to the disk portion of the disk wheel DW2. This enables integral and synchronous rotation of the tires T1 and T2 through the vibrator cases 16.

Each vibration source 17 includes a vibration shaft 22 and an eccentric weight 23. The vibration shaft 22 is arranged coaxially with the tire axis, while its one end is supported on the hub 19 through an automatic aligning roller bearing 24 and the near-to-other end portion thereof is supported on the flange part 16B through an automatic aligning roller bearing 25. Supposing a rotation direction in one direction is a positive rotation, when the vibration motor 2 rotates in both directions, the vibration shaft 22 is rotated positively or reversely. An end cover 26 for covering one end of the vibration shaft 22 and the automatic aligning roller bearing 24 is mounted on the hub 19 by a bolt 27. The other end side of the vibration shaft 22, as described later, is connected to the vibration motor 2.

The eccentric weight 23 is, for example, a variable amplitude eccentric weight. The vibration shaft 22 is capable of positive and reverse rotations, a pair of fixed eccentric weights 23A are fixed to the vibration shaft 22, and a movable eccentric weight 23B is rotatably mounted on the vibration shaft 22 between the paired fixed eccentric weights 23A. A stopper 23C, which can be contacted with the movable eccentric weight 23B to thereby restrict the rotation thereof, is fixed between the fixed eccentric weights 23A and 23A. When the vibration shaft 22 rotates positively, the stopper 23C rotates while pressing one end side of the movable eccentric weight 23B. In this state, the fixed eccentric weight 23A and movable eccentric weight 23B coincide in eccentric directions with each other and thus they operate to compose a vibration force, thereby generating a large vibration force. And, the eccentric moment also increases, thereby enabling the vibration to have a high amplitude. When the vibration shaft 22 rotates reversely, the stopper 23C rotates while pressing the other end side of the movable eccentric weight 23B. In this state, the eccentric directions of the fixed eccentric weight 23A and movable eccentric weight 23B are opposite to each other and thus they operate to cancel their vibration forces, thereby generating a small vibration force and causing the vibration to have a low amplitude.

Figure 4:
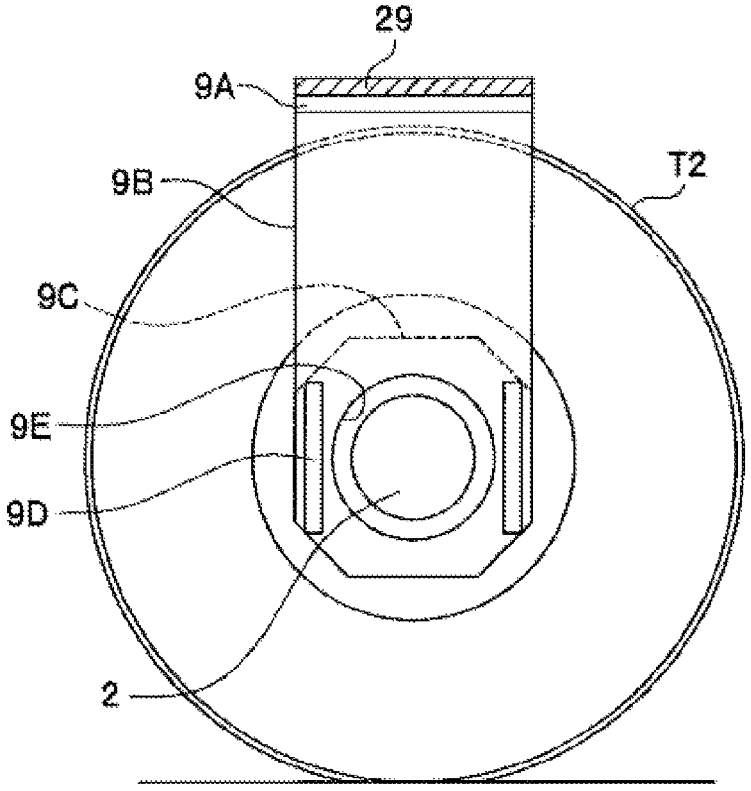
FIG. 4 is a section view taken along the B-B of FIG. 2.

A horizontal support plate 28 is projectingly provided on the upper portion of such plate surface side of the support bracket 8 as is opposed to the tire T2. The outer end of a connecting plate (connecting part) 29 provided above the tire T2 to extend horizontally in the vehicle width direction is fixed to the support plate 28 by a bolt 30. The second support bracket 9 is mounted on the connecting plate 29. That is, in this embodiment, the right second support bracket 9 is connected through the connecting plate 29 to both the paired right and left first support brackets 8, 8 on the unsprung mass side than the vibration proof device 6. Similarly, the left second support bracket 9 is also connected through the connecting plate 29 to both the paired right and left first support brackets 8, 8 on the unsprung mass side than the vibration proof device 6. Each second support bracket 9 includes: a horizontal plate-like fixing part 9A fixed to the lower surface of the connecting plate 29 by bolts 31; a vertically long rectangular base plate part 9B (see FIG. 4) fixed to and hung down from the fixing part 9A, interposed between the tires T2 and T3, and extending longitudinally along the vehicle longitudinal direction; and, a vertical plate-like motor mounting part 9C mounted through a spacer part 9D on the plate surface side of the base plat part 9B opposed to the tire T2, disposed in the internal space of the tire T2, and extending along the vehicle longitudinal direction.

The traveling motor 5 and vibration motor 2 are mounted on the motor mounting part 9C. The traveling motor 5 and vibration motor 2 are constituted of, for example, hydraulic motors. The traveling motor 5 is a motor having a hollow structure with a penetration hole 32. The traveling motor 5 is disposed in the internal space of the tire T2 such that its penetration hole 32 is coaxial with the tire axis and, with its fixing part 5A applied to one surface side of the motor mounting part 9C, it is fixed thereto by a bolt 33. And, the flange portion 34 of the output part is fixed by a bolt 35 through the disk wheel DW2 to the flange part 16A of the vibrator case 16.

Meanwhile, the vibration motor 2 is applied to the other surface side of the motor mounting part 9C and is fixed by a bolt 36. A penetration hole 9E, for insertion of the vibration motor 2, is formed in the base plate part 9B of the second bracket 9. Also, a penetration hole 9F, for insertion of the output shaft of the vibration motor 2, is formed in the motor mounting part 9C of the second support bracket 9. The other end of the vibration shaft 22 is integrally rotatably connected to the output shaft of the vibration motor 2 through a spline sleeve 37 inserted through the penetration hole 32 of the traveling motor 5.

The structure around the tires T1 and T2 is as described above and, as mentioned above, the structure around the tires T3 and T4 is arranged symmetrical with respect to the former. And, the first support bracket 8 interposed between the tires T1 and T2 and the support bracket 8 interposed between the tires T3 and T4 are connected to each other through the connecting plate 29 (connecting part) on unsprung mass side than the vibration proof devices 6, 6, while the second support brackets 9 are mounted on the connecting plate 29. Thus, the right and left first support brackets 8 and right and left second support brackets 9 are all connected integrally on the unsprung mass side than the vibration proof devices 6, 6.

Figure 14:
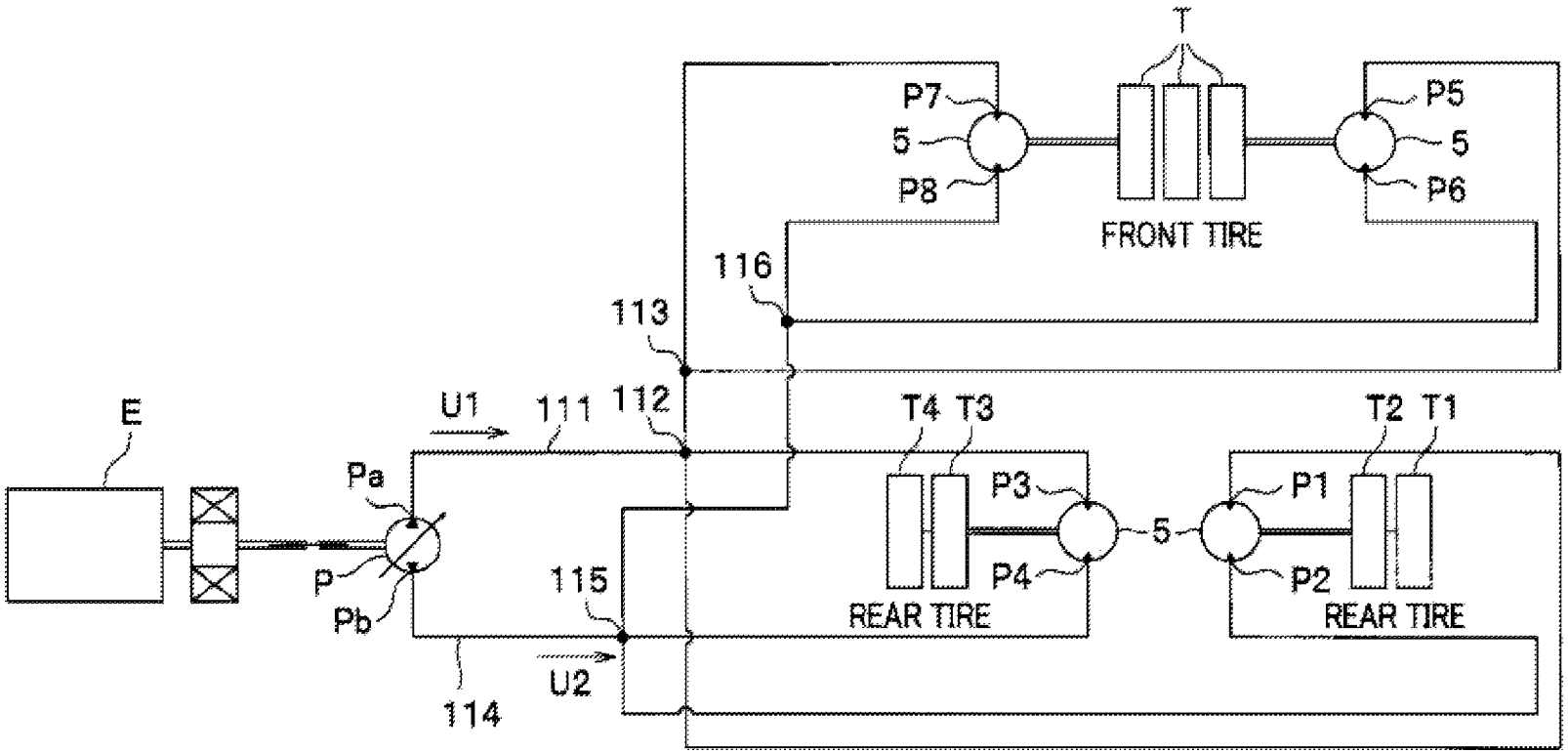
FIG. 14 is a schematic hydraulic circuit diagram relating to a traveling motor.

FIG. 14 shows a schematic hydraulic circuit relating to the traveling motors 5 capable of rotating the tires T1, T2 side and tires T3, T4 side independent of each other, that is, capable of differential rotation. The paired right and left traveling motors 5 on the rear wheel side and the paired right and left traveling motors 5 on the front wheel side are connected in parallel with the hydraulic pump P connected to an engine E carried on a vehicle body. The hydraulic pump P is constituted of a pump having a function to switch the flow direction of pressure oil in a closed circuit and thus, by switching the pressure oil direction to a U1 direction or a U2 direction, it switches the rotation direction of the traveling motors 5 to move the vibration tire roller R forward or backward.

To a flow passage 111 connected to one port Pa of the hydraulic pump P, there are connected through a branch portion 112 a port P1 of the traveling motor 5 for driving the rear wheel tires T1, T2 side, a port P3 of the traveling motor 5 for driving the rear wheel tires T3, T4 side, and further through a branch portion 113 a port P5 of the traveling motor 5 for driving the front wheel right tire T and a port P7 of the traveling motor 5 for driving the front wheel left tire T. To a flow passage 114 connected to the other port Pb of the hydraulic pump P, there are connected through a branch portion 115 a port P2 of the traveling motor 5 for driving the rear wheel tires T1, T2 side and a port P4 of the traveling motor 5 for driving the rear wheel tires T3, T4 side, and further through a branch portion 116 a port P6 of the traveling motor 5 for driving the front wheel right tire T and a port P8 of the traveling motor 5 for driving the front wheel left tire T. Here, in FIG. 14, the front wheel central tire T is treated as a driven tire. However, it may be connected such that it may be rotated simultaneously with the front wheel right or left tire, or may be driven by another traveling motor 5.

As described above, on both of the rear and front wheel sides, the paired right and left traveling motors are connected in parallel with the hydraulic pump P. Therefore, for example, even when, traveling with steering of the vibration tire roller R, there occurs a rotation speed difference between the rear wheel tires T1, T2 side and T3, T4 side, or between the front wheel right and left tires T, a flow rate of pressurized hydraulic oil corresponding to the rotation speed difference is supplied to the respective traveling motors 5, thereby enabling the respective tires to carry out differential rotation.

Operation

When the right and left traveling motors 5, 5 are driven, the vibrator case 16 (traveling drive shaft 4) connected to the flange portion 34 of the output part by the bolt 35 is rotated through the bearings 7 while being supported by the first support bracket 8. Accordingly, the tires T1 and T2 are integrally traveling-rotated through one vibrator case 16, while the tires T3 and T4 are integrally traveling-rotated through the other vibrator case 16. The first support bracket 8 has a function to transmit a load from the sprung mass side to the tire side.

Also, when the right and left vibration motors 2 are driven, the vibration shaft 22 is rotated through the shaft member 37 positively or reversely, while the eccentric action of the eccentric weight 33 causes the vibration shaft 22 to vibrate. The vibration force is transmitted through the automatic aligning roller bearings 24, 25 and vibrator case 16 to the tires T1~T4. Accordingly, on the unsprung mass side than the vibration proof device 6, the tires T1~T4 are vibrated.

Here, although the traveling drive shafts 4 of the tires T1 and T2 are supported by the first support bracket 8 intervening between the tires T1 and T2 and the traveling drive shafts 4 of the tires T3 and T4 are supported by the first support bracket 8 intervening between the tires T3 and T4, their respective traveling motors 5 (and, in this embodiment, vibration motors 2 as well) are supported by the second support brackets 9 intervening between the tires 2 and 3. The second support bracket 9 has a function to receive the driving rotation reaction forces of the traveling motors 5, while no load on the sprung mass side is applied to the traveling motors 5. In this structure, for example, supposing the right second support bracket 9 is connected only to one right support bracket 8, the traveling motor 5 is supported substantially in a cantilever condition. Thus, due to the mass balance difference between the tire T1 and T2 sides, design errors of the eccentric weight position, manufacturing errors and the like, when the vibration of the vibration device 3 is transmitted to the tires T1 and T2, they are easy to vibrate with abnormal oscillation around the horizontal axis in the vehicle longitudinal direction. This phenomenon occurs similarly in the Tires T3 and T4.

In view of this problem, in this embodiment, the right second support bracket 9 is connected through the connecting plate 29 to both of the paired right and left first support brackets 8 on the unsprung mass side than the vibration proof device 6. Similarly, the left second support bracket 9 is connected through the connecting plate 29 to both of the paired right and left first support brackets 8 on the unsprung mass side than the vibration proof device 6. Accordingly, the second support brackets 9 supporting the traveling motors 5 can enhance the substantial rigidity of the first support brackets 8, thereby enabling prevention of the abnormal oscillation.

Also, since the vibration sources 17 of the vibration devices 3 are disposed within the traveling drive shafts 4, vibrations can be applied from the position near to the tire assembly constituted of the two tires T1 and T2, thereby enabling highly efficient vibration transmission to the two tires. Vibrations can be similarly transmitted highly efficiently to the tire assembly constituted of the two tires T3 and T4 as well.

And, the right two tires T1 and T2 and left two tires T3 and T4 can be carried out differential rotation from each other.

Further, if the vibration motor 2 is supported by the second support bracket 9, the traveling motor 5 has a hollow structure including the penetration hole 32 and the vibration motor 2 and vibration source 17 are connected together by the shaft member 37 through the penetration hole 32, the support bracket of the vibration motor do not have to be arranged outwardly of the outside tire as in the JPA Publication No. 2003-184022. According to adopting the above mentioned structure, the vibration tire roller R has no side-overhang, so it is easy for an operator to travel the vibration tire roller R for compaction keeping the outside tire T1 or T4 as near as possible to the structure of a road incidental structure.

Also, in compaction in the vicinity of a curbstone or a wall, in order that a road surface can be compacted up to the corners thereof, an operator tends to perform compaction working in close proximity to the road incidental structure, in some cases, performs compaction while pressing the tire side surface against the wall or the like. Thus, the side surface of the most outside tire is easily damaged to incur frequent replacement of the tire. This embodiment does not use a side plate, a drive motor and the like which disturb mounting and removal of the most outside tire, thereby enabling excellent maintenance performance.

Second Embodiment

Figure 5:
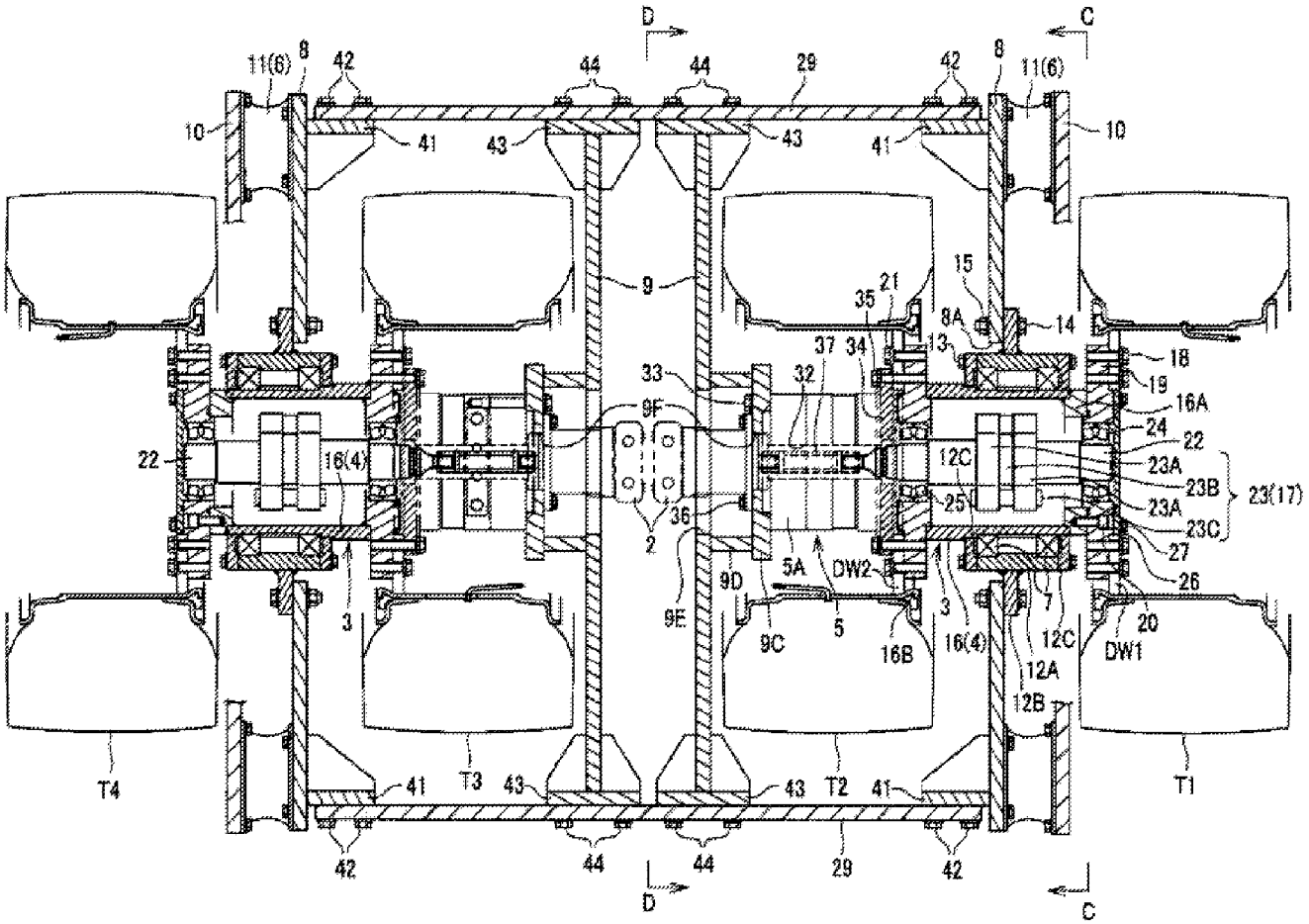
FIG. 5 is a plan view of a second embodiment of the invention around tires.
Figure 6:
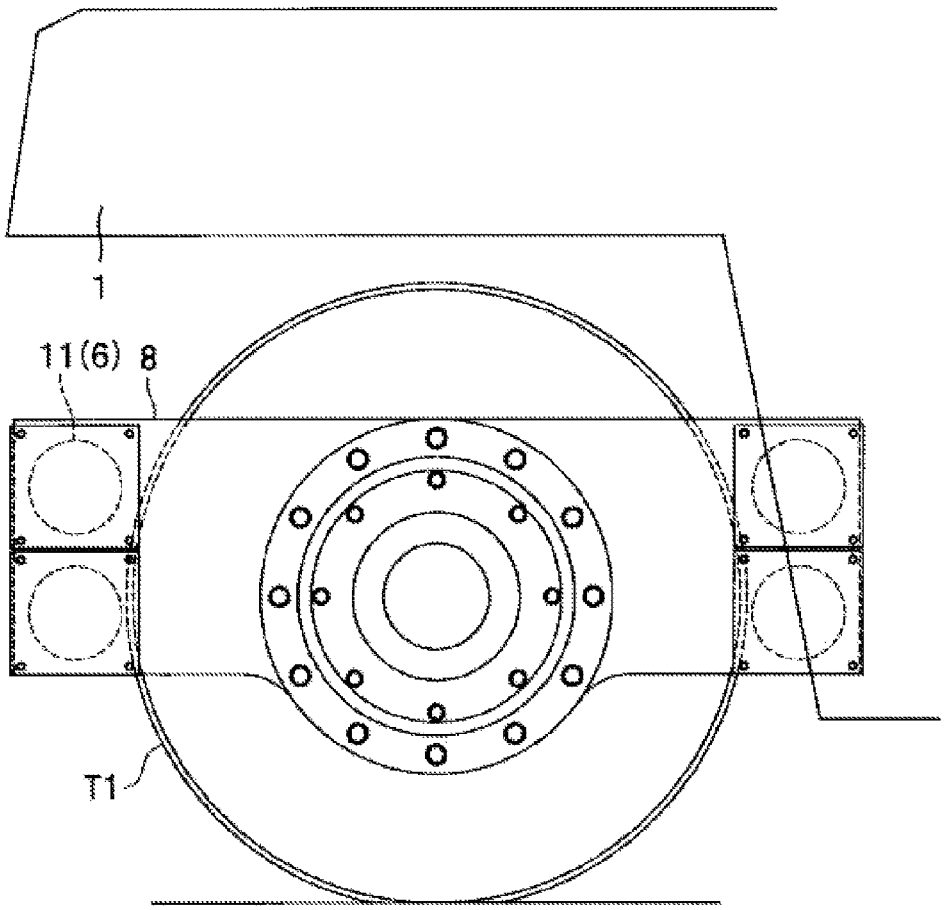
FIG. 6 is a section view taken along the C-C of FIG. 5.
Figure 7:
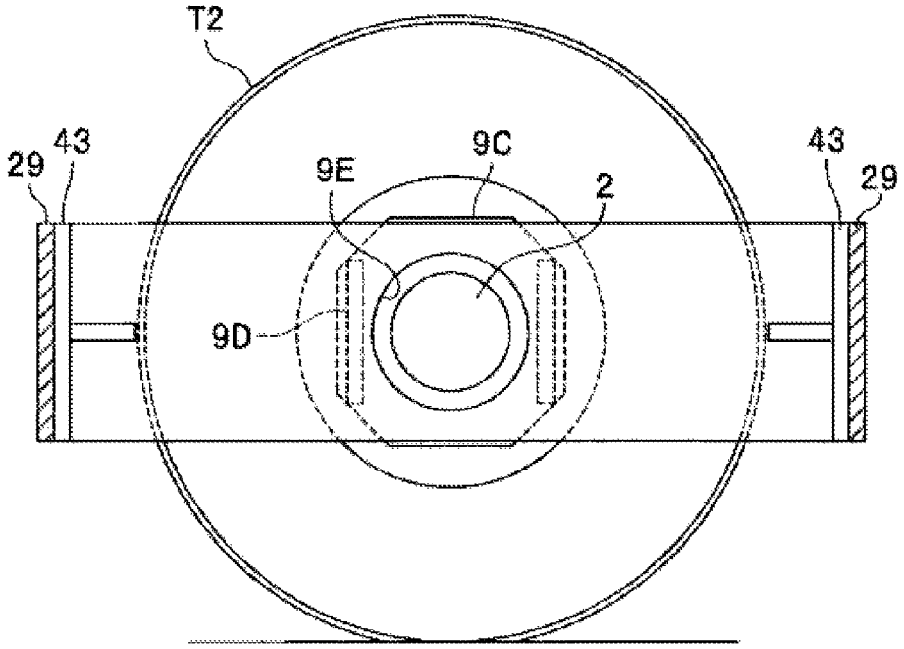
FIG 7 is a section view taken along the D-D of FIG. 5.

Description is given of a second embodiment with reference to FIGS. 5 to 7. FIG. 5 is a plan view around tires, and FIGS. 6 and 7 are respectively section views taken along the C-C and D-D arrows of FIG. 5. In the first embodiment, the connecting plate 29 is arranged above the tires T, whereas, in this embodiment, the connecting plates 29 are arranged before and behind the tires T. The arrangement of other composing elements is the same as those of the first embodiment. The same elements are given the same designations and thus the description thereof is omitted here.

The first support bracket 8 is an oblong rectangular member having a vertical plate-like shape extending along the vehicle longitudinal direction with its front and rear ends situated before and behind the tire T. The first support bracket 8 is mounted on the bracket 10 through four vibration proof rubber members 11 disposed in the four corners thereof. Support plates 41 are mounted by welding or the like on the front and rear surfaces of the vehicle-width-direction inside plate surface of the first support bracket 8. The right and left first support brackets 8 are connected together before the tires T2 and T3 by a connecting plate (connecting part) 29 extended between right and left support plates 41 and, also behind the tires T2 and T3, are connected by a connecting plate (connecting part) 29 extended between right and left support plates 41. The connecting plate 29 is a member extending in the vehicle-width direction with a vertical plate surface. The connecting plate 29 is fixed to the support plate 41 by bolts 42. The first support bracket 8 has a function to transmit a load from the sprung mass side to the tire side.

A pair of second support brackets 9 are interposed between the tires T2 and T3 and are extended between the front and rear connecting plates 29. Each second support bracket 9 includes in their front and rear ends support plates 43 to be fixed to the connecting plates 29 by bolts 44. Accordingly, the right second support bracket 9 is connected through the front and rear connecting plates 29 to both of the paired right and left first support brackets 8 on the unsprung mass side than the vibration proof device 6. Similarly, the left second support bracket 9 is also connected through the front and rear connecting plates 29 to both of the paired right and left first support brackets 8 on the unsprung mass side than the vibration proof device 6. The second support bracket 9 has a function to receive the drive rotation reaction force of the traveling motor 5, while the load on the sprung mass side is not applied to the traveling motor 5.

In this second embodiment as well, since the right second support bracket 9 is connected through the connecting plates 29 to both of the paired right and left first support brackets 8 on the unsprung mass side than the vibration proof device 6, when the vibration of the vibration device 3 is transmitted to the tires T1 and T2, the tire T1 and T2 can vibrate respectively without abnormal oscillation around the horizontal axis in the vehicle longitudinal direction even with a mass balance difference between the tire T1 and T2 sides, design errors of the eccentric weight position, manufacturing errors or the like. Similarly, since the left second support bracket 9 is connected through the connecting plates 29 to both of the paired right and left first support brackets 8 on the unsprung mass side than the vibration proof device 6, when the vibration of the vibration device 3 is transmitted to the tires T3 and T4, the tires T3 and T4 can vibrate respectively without abnormal oscillation around the horizontal axis in the vehicle longitudinal direction even with a mass balance difference between the tire T3 and T4 sides, design errors of the eccentric weight position, manufacturing errors or the like.

In this second embodiment, since the front and rear ends of the second support bracket 9 are connected to the front and rear connecting plates 29, when compared with the first embodiment, due to the plate widths of the connecting plates 29, the substantial rigidity of the first support brackets 8 supporting the whole tire assembly around the horizontal axis in the vehicle longitudinal direction can be enhanced further, thereby enabling effective prevention of the above-mentioned abnormal oscillation.

Also, similarly to the first embodiment, since the vibration source 17 of the vibration device 3 is disposed in within the traveling drive shaft 4, vibrations can be applied from the position near to the tire assembly constituted of the two tires T1 and T2, thereby enabling highly efficient vibration transmission to the two tires. Similarly, vibrations can be transmitted highly efficiently also to the tire assembly constituted of the two tires T3 and T4.

Further, similarly to the first embodiment, since the vibration motor 2 is supported by the second support bracket 9, the traveling motor 5 has a hollow structure including the penetration hole 32, and the vibration motor 2 and vibration source 17 are connected together by the shaft member 37 through the penetration hole 32, there is eliminated the need to arrange the vibration motor support bracket outwardly of the outside tire as in the JPA Publication No. 2003-184022. This eliminates the side overhang, whereby the outside tires T1 and T4 can be made to approach to the vicinity of a road incidental structure as near as possible for compaction.

Also, similarly to the first embodiment, since compaction is performed while pressing the tire side surface against the wall or the like, even when the outside surface of the most outside tire is damaged and thus the tire is replaced frequently, maintenance performance is excellent because a side plate, a drive motor and the like disturbing mounting and removal of the most outside tire are eliminated.

Third Embodiment

Figure 8:
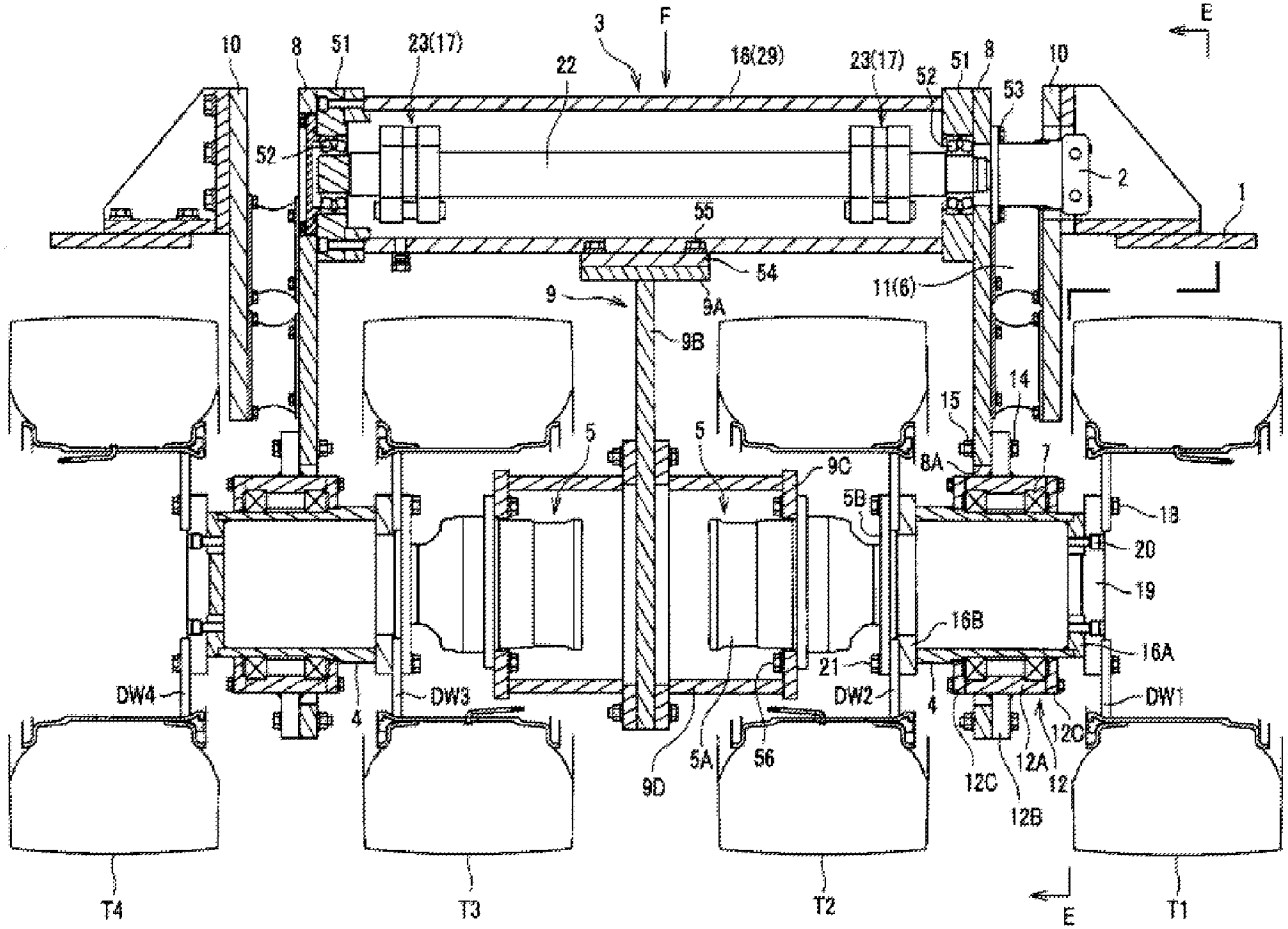
FIG. 8 is a rear view of a third embodiment of the invention around tires.
Figure 9:
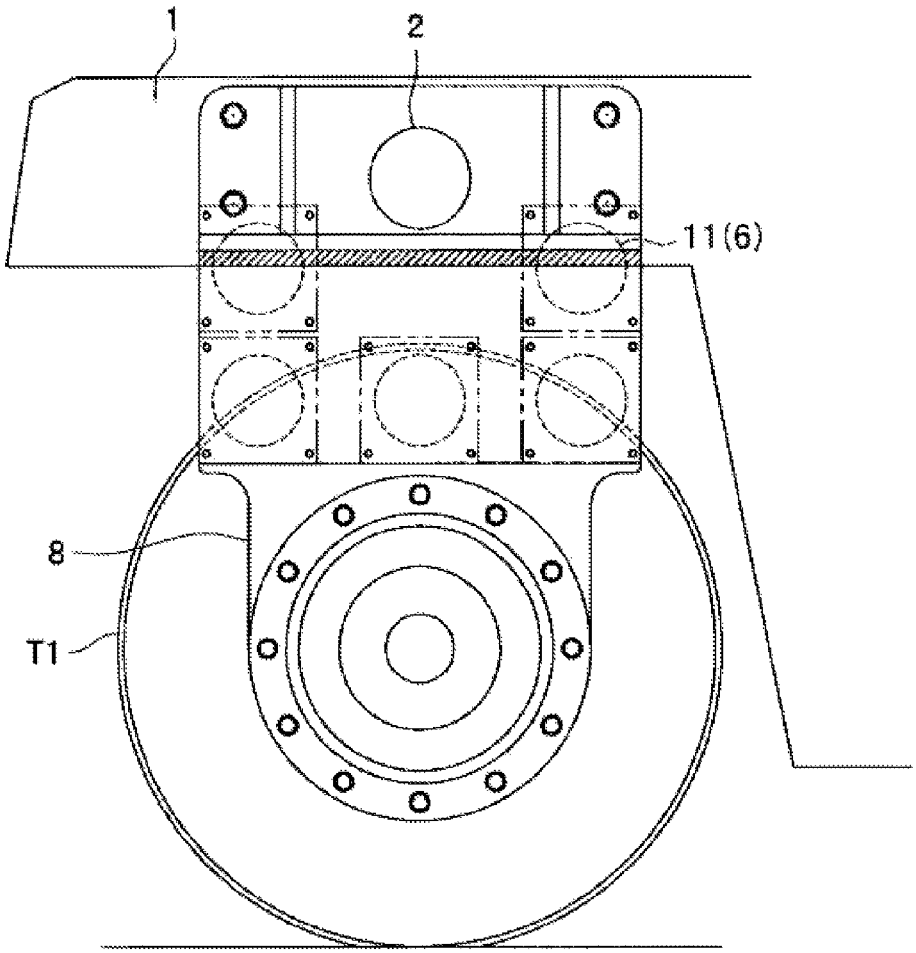
FIG. 9 is a section view taken along the E-E of FIG. 8.
Figure 10:
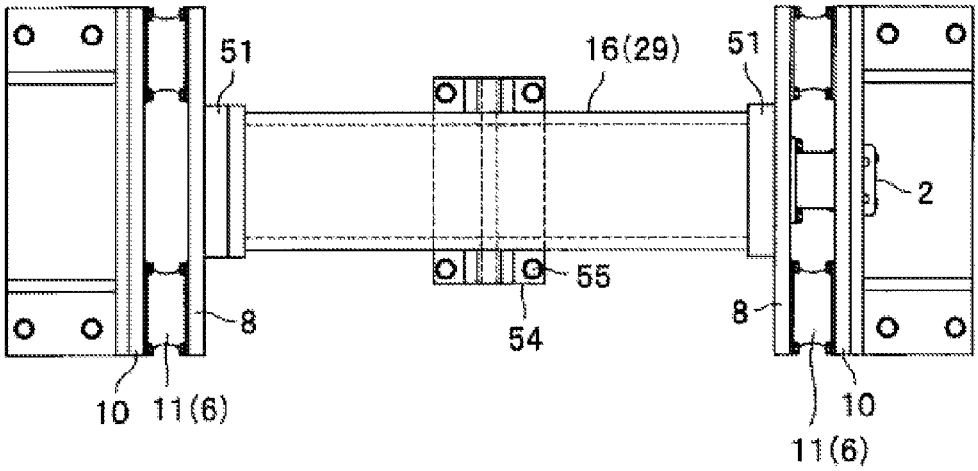
FIG. 10 is a view seen from the direction of the arrow F of FIG. 8.

Description is given of a third embodiment with reference to FIGS. 8 to 10. FIG. 8 is a rear view around tires, and FIGS. 9 and 10 are respectively a section view taken along the arrow E-E and a view taken along the arrow F shown in FIG. 8. In the first and second embodiments, the vibration source 17 of the vibration device 3 is disposed within the traveling drive shaft 4, whereas, in this embodiment, the vibration device 3 is mounted such that its vibrator case 16 extends between a pair of first support brackets 8 above the tire T. The vibrator case 16 has a function to serve as a connecting part to connect the second support bracket 9 to both of the paired light and left support brackets 8 on the unsprung mass side than the vibration proof device 6. Here, the same elements as in the first and second embodiments are given the same designations.

A vertical plate-like bracket 10 is fixed to the vehicle body 1 so as to be intervening between the tires T1 and T2 and hanging down along the vehicle longitudinal direction. On the plate surface side of the bracket 10 opposed to the tire T2, the first support bracket 8 is mounted through multiple (in the drawings, five) vibration proof rubber members 11 constituting the vibration proof devices 6. The first support bracket 8 is a vertical plate-like member extending along the vehicle longitudinal direction, the lower portion thereof has a substantially semi-circular shape as shown in FIG. 9. A penetration hole 8A for insertion of a bearing holder 12 is formed in the center of the substantially semi-circular shape of the first support bracket 8 as shown in FIG. 8.

The bearing holder 12 is the same in structure as those in the first and second embodiments and, with its cylindrical portion 12A penetrated through the penetration hole 8A of the first support bracket 8, its flange portion 12B is fixed to the first support bracket 8 by a bolt 14 and a nut 15. The outer rings of a pair of bearings 7 are engaged into the inner peripheral surface of the cylindrical portion 12A. The traveling drive shaft 4 is a cylindrical member with two open ends. When it is engaged into the inner rings of the bearings 7, it is rotatably supported through the bearings 7 by the first support bracket 8. Of the two end openings of the traveling drive shaft 4, to the opening near to the tire T1, the flange portion 16 is mounted by welding or the like and, to the opening near to the tire T2, the flange portion 16 is mounted by welding or the like. The traveling drive shaft 4 is fixed, in the flange part 16A, by a bolt 20 to a hub 19 fixed to the disk portion of the disk wheel DW1 by a bolt 18 and, in the flange part 16B, to the disk portion of the disk wheel DW2 by a bolt 21. This enables integral and synchronous rotation of the tires T1 and T2 through the traveling drive shaft 4.

The vibrator case 16 of the vibration device 3 is a cylindrical member with bearing holders 51 mounted on the two end thereof and is extended above the tires T2 and T3 between the right and left first brackets 8. A portion of the vehicle body 1 is cut out in order to avoid interference with the vibrator case 16. Within the vibrator case 16, a vibration shaft 22 is supported by automatic aligning roller bearings 52 fitted within the respective bearing holders 51. One end of the vibration shaft 22 is integrally rotatably connected to the output shaft of the vibration motor 2 fixed to one support bracket 8 by a bolt 53. An eccentric weight 23 is mounted on the vibrating shaft 22 similar to the first and second embodiments.

As shown in FIG. 10 as well, a rectangular support plate 54, on which the second support bracket 9 is connected, is horizontally fixed to the vehicle width-direction central lower portion of the vibrator case 16. The second support bracket 9 includes a horizontal plate-like fixing portion 9A fixed to the lower surface of the support plate 54 by a bolt 55, a vertically long rectangular base plate portion 9B extending along the vehicle longitudinal direction, and vertical plate-like motor mounting portions 9C mounted through spacer portions 9D to both plate surfaces of the base plate portion 9*b*, situated in the inner space of the tire T2 and extending along the vehicle longitudinal direction. In the first and second embodiments, a pair of second brackets 9 are provided, whereas, in this embodiment, only one second support bracket 9 is provided. In other embodiments, it is also permitted that the pair of second support brackets 9 can be integrated to one second support bracket 9 if there is no problem of parts size and parts arrangement.

Traveling motors 5 are mounted on the motor mounting portions 9C respectively. The traveling motors 5 have an ordinary structure not a hollow structure, while their fixing portions 5A are fixed to the motor mounting portions 9C by bolts 56 and their output portions 5B are fixed to the disk portions of the disk wheels DW2 and DW3 by the bolts 21.

Operation

When the right and left traveling motors 5 are driven and the output portions 5B are rotated, the tires T1 and T2 are traveling rotated integrally through one traveling drive shaft 4 and the tires 3 and T4 are traveling rotated integrally through the other traveling drive shaft 4. The first support bracket 8 has a function to transmit a load from the sprung mass side to the tire side. The second support bracket 9 has a function to receive the drive rotation reacting force of the traveling motor 5, while the load on the sprung mass side is not applied to the traveling motor 5.

Also, when the vibration motor 2 is driven, the vibration shaft 22, supposing one direction rotation is called positive rotation, rotates positively or reversely, whereby the eccentric action of the eccentric weight 23 causes the vibration shaft 22 to vibrate. The vibrating force thereof is transmitted through the bearing 52, bearing holder 51, first support bracket 8 and traveling drive shaft 4 to the tires T1~T4. Thus, on the unsprung mass side than the vibration proof device 6, the tires T1~T4 are vibrated.

In the third embodiment as well, since the second support bracket 9 is connected through the vibrator case 16 to both of the paired right and left first support brackets 8 on the unsprung mass side than the vibration proof device 6, when the vibrations of the vibration device 3 are transmitted to the tires T1 and T2 even with the mass balance difference between the tire T1 and T2 sides, design errors of the eccentric weight position, manufacturing errors and the like, they can be vibrated relatively with no abnormal oscillation around the horizontal axis in the vehicle longitudinal direction. This also applies to the tires T3 and T4 similarly.

Also, in the first and second embodiments, the paired right and left vibration devices 3 and paired right and left vibration motors 2 are provided, whereas, in this embodiment, the single vibration device 3 and single vibration motor 2 are provided above the tires T. There is no need to use of an expensive hollow motor as the traveling motor 5 in order to connect the vibration device 3 and vibration motor 2 as in the first and second embodiments. In addition, each vibration device and vibration motor is needed only one.

Further, since this embodiment eliminates the need to arrange the support bracket of the vibration motor outwardly of the outside tire as in the JPA Publication No. 2003-184022, the side overhang is eliminated and thus the outside tires T1 and T4 can be made to approach to the vicinity of a road incidental structure as near as possible for compaction.

And, similarly to the first embodiment, compaction is performed while pressing the tire side surface against a wall or the like. Thus, even when the side surface of the most outside tire is damaged to incur frequent replacement of the tire, maintenance performance is excellent because of no provision of a side plate, a drive motor and the like disturbing mounting and removal of the most outside tire.

Fourth Embodiment

Figure 11:
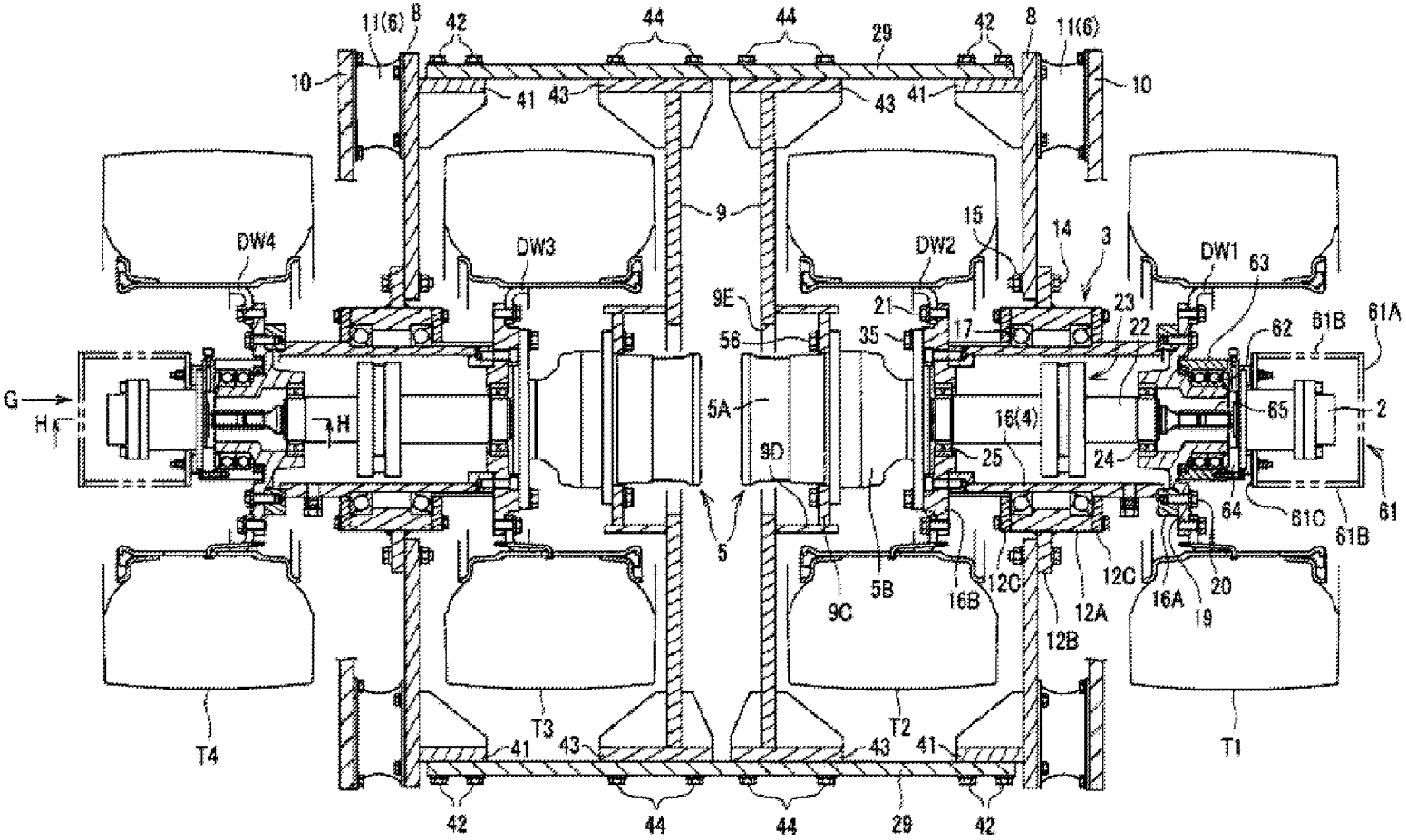
FIG. 11 is a plan view of a fourth embodiment of the invention around tires.
Figure 12:
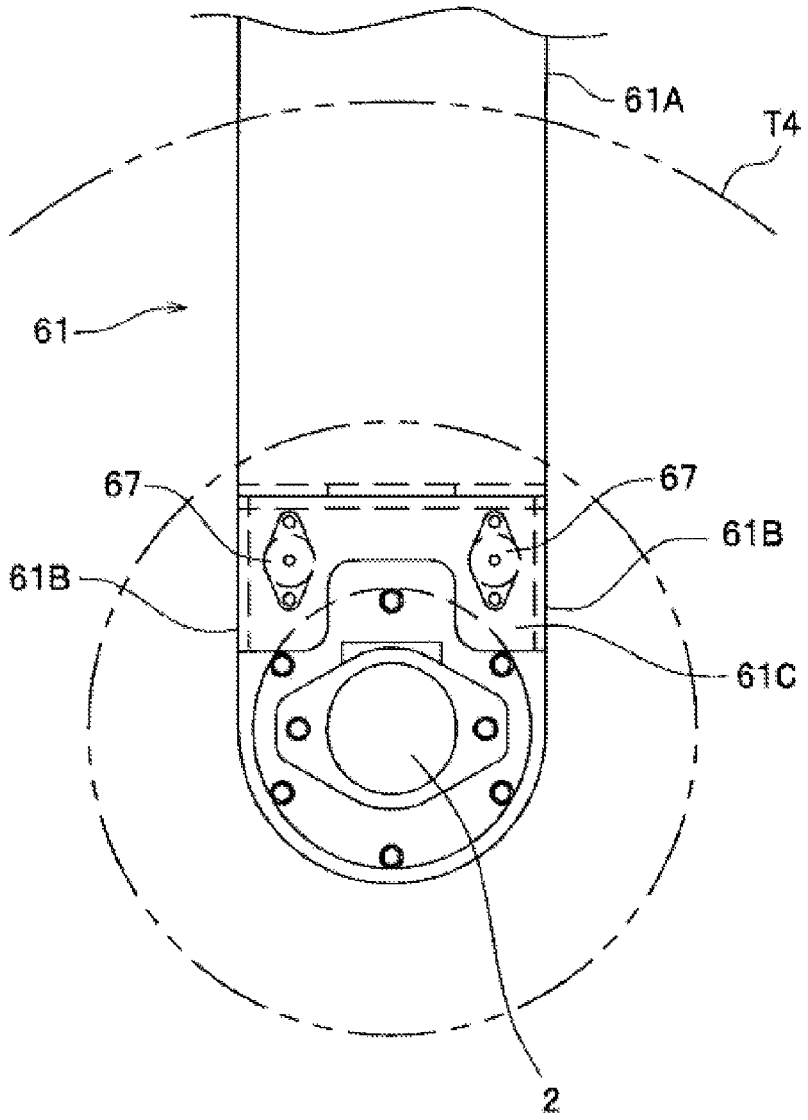
FIG. 12 is a view seen from the direction of the arrow G of FIG. 11.
Figure 13:
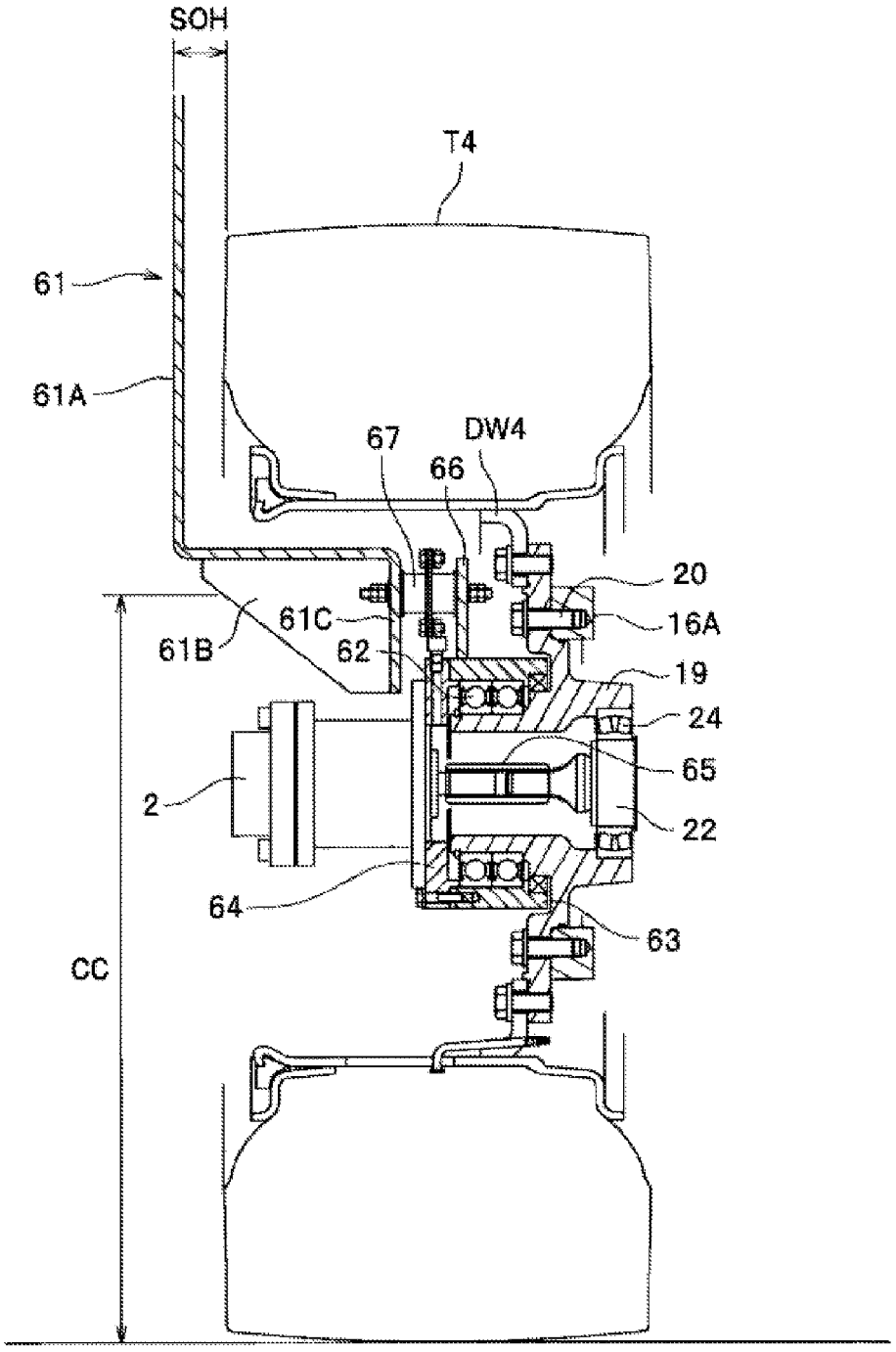
FIG. 13 is a section view taken along the H-H of FIG. 11.

Description is given of a fourth embodiment with reference to FIGS. 11~13. FIG. 11 is a plan view around tires, and FIGS. 12 and 13 are respectively a view taken along the arrow G and a section view taken along the arrow H-H in FIG. 11. This embodiment is characterized mainly in that it includes third support brackets 61 mounted on the vehicle body 1 and situated outwardly of the outside tires T1 and T4 and the vibration motor 2 is supported by the third support brackets 61. Here, the same elements as in the first to third embodiments are given the same designations and description of the partially duplicated structures thereof is omitted.

The structures of the first support brackets 8, second support brackets 9 and connecting plates 29 are substantially similar to the second embodiment. That is, the first support bracket 8 is an oblong rectangular member having a vertical plate-like shape extending along the vehicle longitudinal direction with its front and rear ends situated before and behind the tire T. The first support bracket 8 is mounted on the bracket 10 through four vibration proof rubber members 11 arranged in the four corners thereof. Support plates 41 are mounted by welding or the like on the front and rear ends of the vehicle width direction inside plate surfaces of the first support bracket 8. The right and left first support brackets 8 are connected together before and behind the tires T2 and T3 by the connecting plates (connecting parts) 29 extended between the right and left support plates 41. And, a pair of second support brackets 9 are extended between the front and rear connecting plates 29 in a space intervening between the tires T2 and T3. Thus, the right and left second support brackets 9 are respectively connected through the front and rear connecting plates 29 to both of the paired right and left first support brackets 8 on the unsprung mass side than the vibration proof device 6.

Traveling motors 5 are mounted to the motor mounting portions 9C of the second support brackets 9. The traveling motor 5 has an ordinary structure but not a hollow structure. The fixing portion 5A thereof is fixed to the motor mounting portion 9C by bolts 56, while the output portion 5B is fixed to the disk portions of the disk wheels DW2 and DW3.

Bearing cases 63 are mounted through bearings 62 on the outer peripheries of the barrel portions of hubs 19 mounted on the disk portions of the disk wheels DW1 and DW4 of the tires T1 and T4. Each hub 19 is fixed to the flange portion 16A of the vibrator case 16 by a bolt 20. The vibration motors 2 are respectively disposed within the tires T1 and T4 and are mounted on the bearing cases 63 through their associated mounting seats 64. The output shaft of each vibration motor 2 is connected through a coupling 65 to the vibration shaft 22.

A flange plate 66 (FIG. 13) is fixed to the outer peripheral upper portion of each bearing case 63. The third support brackets 61 respectively include first plate parts 61A hanging down from the side surface of the vehicle body 1 (not shown) along the vehicle longitudinal direction outwardly of the tires T1 and T4 and then extending horizontally such that the lower ends thereof project into the tires T1 and T4, reinforcing second plate parts 61B formed below the first plate parts 61A along the vehicle width direction, and third plate parts 61C formed along the vehicle longitudinal direction within the tires T1 and T4. The first and third plate parts 61A and 61C are formed integrally. And, the third plate part 61C and the flange plate 66 of the bearing case 63 are connected together through an vibration proof rubber member 67 (67). That is, the vibration motor 2 is supported through the bearing case 63 and vibration proof rubber member 67 by the third support bracket 61. The vibration proof rubber member 67 has a function to separate vibrations generated in the vibration shaft 22 by the rubber material thereof so that they are prevented against transmission to the third support bracket 61.

Operation

When the right and left traveling motors 5 are driven and the output portions 5B are rotated, the tires T1 and T2 are integrally traveling rotated through the vibrator case 16 serving one traveling drive shaft 4, while the tires T3 and T4 are integrally traveling rotated through the vibrator case 16 serving the other traveling drive shaft 4. The first support bracket 8 has a function to transmit a load from the sprung mass side to the tire side. The second support bracket 9 has a function to receive the drive rotation reaction force of the traveling motor 5, while the load on the sprung mass side is not applied to the traveling motor 5.

Also, when the vibration motor 2 is driven, the vibration shaft 22, supposing rotation in one direction is called positive rotation, is rotated positively or reversely, whereby the eccentric action of the eccentric weight 23 causes the vibration shaft 22 to vibrate, the vibration is transmitted to the tires T1~T4 to thereby vibrate them on the unsprung mass side than the vibration proof devices 6.

In this fourth embodiment as well, since the right second support bracket 9 is connected through the connecting plate 29 to both of the paired right and left first support brackets 8 on the unsprung mass side than the vibration proof device 6, when the vibrations of the vibration device 3 are transmitted to the tires T1 and T2 even with a mass balance difference between the tire T1 and T2 sides, design errors of the eccentric weight position, manufacturing errors and the like, they can be vibrated relatively with no abnormal oscillation around the horizontal axis in the vehicle longitudinal direction. Similarly, since the left second support bracket 9 is connected through the connecting plate 29 to both of the paired right and left first support brackets 8 on the unsprung mass side than the vibration proof device 6, when the vibrations of the vibration device 3 are transmitted to the tires T3 and T4 even with a mass balance difference between the tire T3 and T4 sides, design errors of the eccentric weight position, manufacturing errors and the like, they can be vibrated respectively with no abnormal oscillation around the horizontal axis in the vehicle longitudinal direction.

In this fourth embodiment, the front and rear ends of the second support brackets 9 are connected to the front and rear connecting plates 29 and thus, due to the plate widths of the connecting plates 29, the substantial rigidity of the first support brackets 8 supporting the whole tire assembly around the horizontal axis in the vehicle body longitudinal direction can enhanced still further when compared with the first embodiment, thereby enabling effective prevention of the abnormal oscillation.

Also, the third support bracket 61 is used mainly to fix the main body of the vibration motor 2 against rotation and thus it may be thinner than the first support bracket 8 for receiving the load on the sprung mass side. This can minimize the side overhang SOH (FIG. 13) which is the projection distance from the outside surface of the tire T. Also, curve clearance CC (FIG. 13), which is the height distance of the third support bracket 61 at the position of the outside surface of the tire T, can also be situated above the tire center. This enables the outside tires T1 and T4 to approach to the vicinity of a road incidental structure as near as possible for compaction.

Description has been given heretofore of the preferred embodiments of the invention. The invention can apply not only to a vibration tire roller in which front and rear wheels are all constituted of tires but also to a combined type compaction roller in which one of front and rear wheels is constituted of a steel wheel.

And, as the bearing 7 to be interposed between the traveling drive shaft 4 and first support bracket 8, for example, a slewing bearing can also be used.

Also, in the first, second and fourth embodiments, through the connecting plates 29 extended between the right and left first brackets 8, and in the third embodiment, through the vibrator cases 16 extended between the right and left first brackets 8, the second support brackets 9 are connected to both of the paired right and left first support brackets 8 on the unsprung mass side than the vibration proof devices 6. However the invention is not limited to these structures. For example, while the right second support bracket 9 is mounted on only the right first support bracket 8 and the left second support bracket 9 is mounted on only the left first support bracket 8, the right and left support brackets 9 may be connected directly to each other through the connecting plates. That is, the right second support bracket 9 is connected to the right first support bracket and is also connected through the connecting plates and the left second support bracket 9 to the left first support bracket. Similarly, the left second support bracket 9 is connected to the left first support bracket and is also connected through the connecting plates and the right second support bracket 9 to the right first support bracket. This structure also can prevent the respective two tires T sandwiching the first support brackets 8 between them against vibration with abnormal oscillation around the horizontal axis in the vehicle longitudinal direction.

Also, in the first, second and fourth embodiments, the second support bracket 9 is provided as a pair of right and left brackets. However, so long as there arises no problem of parts size and parts arrangement, it is also permitted that the pair of second support brackets 9 can be integrated to one second support bracket 9.

Fifth Embodiment

Figure 15:
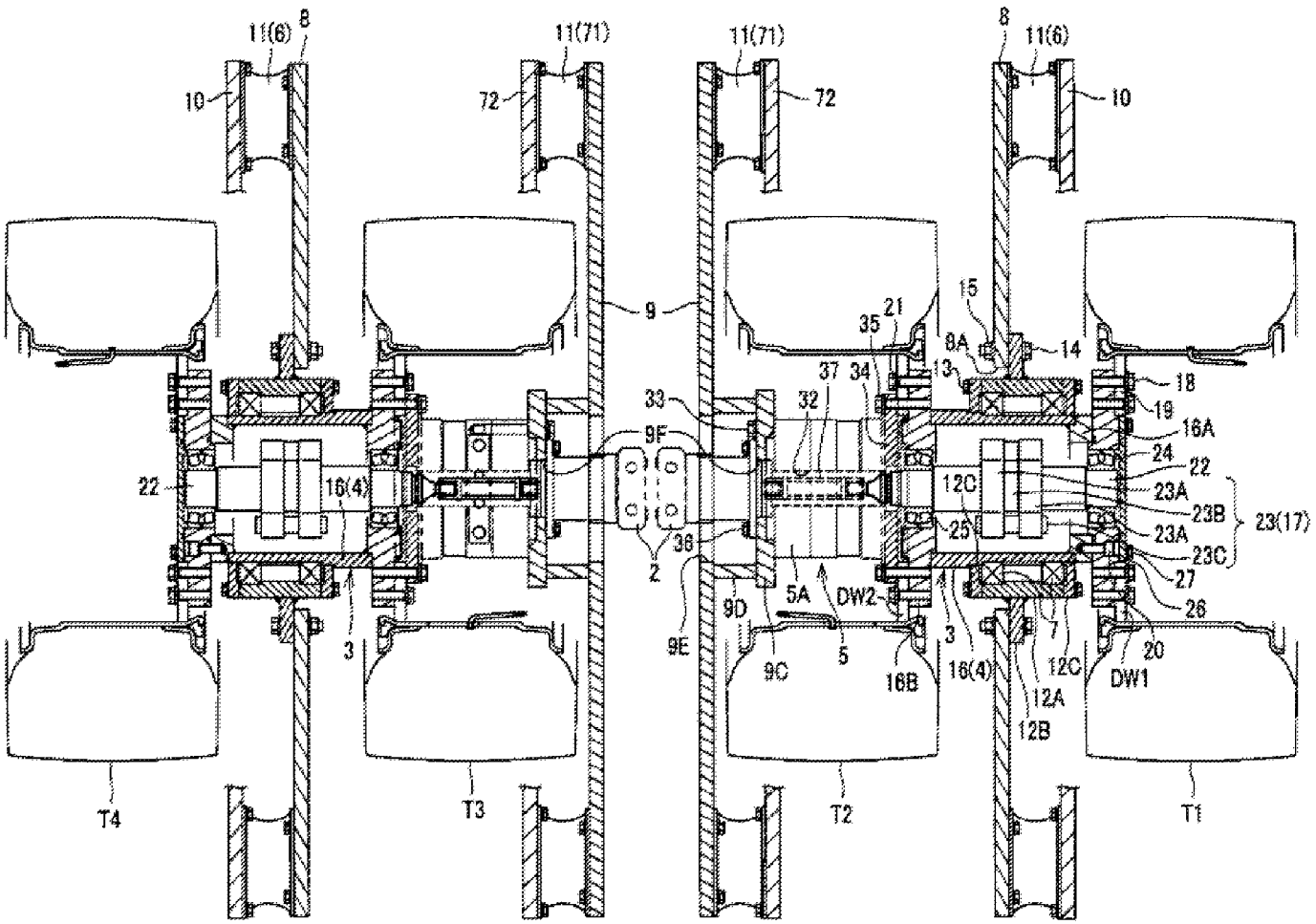
FIG. 15 is a plan view of a fifth embodiment of the invention around tires.

Description is given of a fifth embodiment with reference to FIG. 15. In all of the first to fourth embodiments, the second support brackets 9 are connected to both of the paired right and left first support brackets 8 on the unsprung mass side than to the first vibration proof devices 6 and are interposed between the inside tires T2 and T3. However, in this embodiment, the second support brackets 9 are mounted on the vehicle body 1 through second vibration proof devices 71 different from the first vibration proof devices 6 and are interposed between the inside tires T2 and T3. Other structures than the mounting structure of the second support brackets 9 are the same as the first and second embodiments. The same elements are given the same designations and thus the description thereof is omitted.

Above the tires T1 and T2, to the vehicle body 1, there are fixed vertical plate-like brackets 72 such that they hang down along the vehicle longitudinal direction. Here, in order to prevent the brackets 72 from interfering with the tires T1 and T2, for example, they are cut in the central portions of the lower sides thereof. Multiple vibration proof rubber members 11 constituting the second vibration proof device 71 are mounted on the brackets 72. As the vibration proof rubber members 11 constituting the second vibration proof device 71, the same members as the vibration proof rubber members 11 constituting the first vibration proof devices 71 can be used. The paired right and left second support brackets 9 are respectively mounted on the brackets 72 through the vibration proof rubber members 11 of the second vibration proof device 71. Here, the paired right and left second brackets 9 may also be connected together by a connecting member (not shown).

According to this embodiment, using the second support brackets 9 mounted on the vehicle body 1 through the second vibration proof devices 71, the drive rotation reaction force of the traveling motors 5 can be received by a simple structure to thereby prevent the tires against vibration with abnormal oscillation around the horizontal axis in the vehicle body longitudinal direction.

Also, similarly to the first, second and fourth embodiment, since the vibration source 17 of the vibration device 3 is disposed within the traveling drive shaft 4, vibrations can be applied from a position near to the tire assembly constituted of the two tires T1 and T2, thereby enabling highly efficient vibration transmission to the two tires. Highly efficient vibration transmission to the tire assembly constituted of the two tires T3 and T4 is also possible similarly.

Further, similarly to the first and second embodiments, the vibration motor 2 is supported by the second support bracket 9, the traveling motor 5 is constituted of a hollow-structure motor having the penetration hole 32, and the vibration motor 2 and vibration source 17 are connected together through the penetration hole 32 by a shaft member 37, thereby eliminating the need to arrange the support bracket of the vibration motor outwardly of the outside tires as in the JPA Publication No. 2003-184022. This eliminates the side overhang and thus enables the outside tires T1 and T4 to approach to the vicinity of a road incidental structure as near as possible for compaction.

The invention claimed is:

1. A compaction roller of a type that a front wheel or a rear wheel includes four tires coaxially arranged side by side in a vehicle width direction and four tires arranged in two pairs in which one pair is arranged in a right side of the compaction roller and the other pair is arranged in a left side of the compaction roller, the compaction roller comprising:

a pair of traveling drive shafts, each of which is arranged corresponding to one of the two pairs of tires and drives an outside tire and its adjoining inside tire of the corresponding pair of tires synchronously and transmits a vibration from a vibration device, which generates the vibration when driven by a vibration motor, to the outside and inside tires;

a pair of traveling motors, each of which is arranged corresponding to one of the pair of traveling drive shafts and drives the corresponding traveling drive shaft; and a pair of first support brackets, each of which is arranged corresponding to one of the pair of traveling drive shafts and is mounted through a first vibration proof device on a vehicle body and interposed between the outside and inside tires and supports the corresponding traveling drive shaft through a bearing device, wherein the vibration device includes a pair of vibration sources each of which is disposed within the corresponding traveling drive shaft.

2. The compaction roller according to claim 1, further including a second support bracket which is connected to both of the pair of first support brackets on an unsprung mass side than the first vibration proof device and interposed between the inside tires, and supports one of the pair of traveling motors.

3. The compaction roller according to claim 1, further including a second support bracket which is connected to the vehicle body through a second vibration proof device and interposed between the inside tires, and supports one of the pair of traveling motors.

4. The compaction roller according to claim 2, further including a third support bracket which is connected to the vehicle body and situated outwardly of the outside tire in the vehicle width direction, and supports the vibration motor.

5. The compaction roller according to claim 2, wherein the vibration motor is supported by the second support bracket, each of the traveling motors is constituted of a motor of a hollow structure having a penetration hole, and the vibration motor and the vibration source are connected through the penetration hole to each other by a shaft member.

* * * * *